United States Patent [19]

Neuschatz

[11] 4,075,782

[45] Feb. 28, 1978

[54] DOLL SHOWING SICKNESS, AND MEANS FOR "CURING"

[76] Inventor: Joseph J. Neuschatz, 42 Old Homestead Road, Port Jefferson, N.Y. 11777

[21] Appl. No.: 635,031

[22] Filed: Nov. 25, 1975

[51] Int. Cl.[2] ..... A63H 13/00

[52] U.S. Cl. ..... 46/118; 46/135 R; 46/227; 46/228; 46/264; 35/17

[58] Field of Search ..... 46/116, 117, 45, 118, 46/264, 268, 226, 227, 228, 229; 35/17

[56] References Cited

U.S. PATENT DOCUMENTS

| | | | |
|---|---|---|---|
| 2,185,190 | 1/1940 | Gorbea et al. | 46/141 |
| 2,531,912 | 11/1950 | Kahn | 46/116 UX |
| 2,732,658 | 1/1956 | Goldfarb | 46/116 |
| 2,774,184 | 12/1956 | Hefferan et al. | 46/116 X |
| 2,781,611 | 2/1957 | Bills et al. | 46/116 X |
| 2,959,891 | 11/1960 | Barnett et al. | 46/116 X |
| 3,190,037 | 6/1965 | Giordano | 46/227 |
| 3,232,004 | 2/1966 | Felshen | 46/228 X |
| 3,234,687 | 2/1966 | Elwell | 46/117 |
| 3,239,961 | 3/1966 | Forkner | 46/228 |
| 3,383,795 | 5/1968 | Ryan et al. | 46/264 |
| 3,514,899 | 6/1970 | Bonanno et al. | 46/118 X |
| 3,662,076 | 5/1972 | Gordon et al. | 35/17 |
| 3,918,199 | 11/1975 | De Masi | 46/264 |

*Primary Examiner*—F. Barry Shay

*Attorney, Agent, or Firm*—Roylance, Abrams, Berdo & Kaul

[57] ABSTRACT

A doll in which an illness symptom is created, a treatment is administered and in which the treatment removes the symptom. One symptom is a fever produced by closing a switch which heats the doll's forehead and moving a member near an orifice of the doll's body, the forehead temperature being recognizable by touch and the oral or other indication being detectable by a simulated thermometer. The treatment comprising insertion of a spoon or simulated pill to open the switch and restore the member. Measles (roseola) is simulated by closing a switch to illuminate translucent portions in the body, presenting the appearance of spots. Mumps is simulated by inflating portions of the cheeks and neck, treatment comprising moving a valve member to slowly deflate the portions. Tachycardia is produced by changing the speed of a motor which drives a heartbeat simulating device. Cough-like sound will be produced by recording devices.

The doll may also be provided with surgical incisions held closed by VELCRO; multipart arms to simulate fractures; internal balloons which set the fractures when inflated; casts for the limbs; indicator fluids visible at orifices; syringe apertures in the arm and an anaesthic mask, with the doll's eyes arranged to close an injection is given or as mask is fitted in place (a vocal response to anaesthic may also be arranged); or with magnetic misaligned eyeballs which becomes aligned when glasses are fitted in place.

8 Claims, 19 Drawing Figures

DOLL SHOWING SICKNESS, AND MEANS FOR "CURING"

BACKGROUND OF THE INVENTION

The present invention relates to dolls and, more particularly, to dolls which can be made to exhibit a symptom or symptoms of illness or injury which will diminish or disappear in response to an act or acts simulating a proper treatment for the illness or injury.

PRIOR ART

Many forms of dolls of varying degrees of sophistication have been proposed and commercialized in the prior art. Thus, it is well known to provide walking, talking or sleeping dolls, which represent particular human classes, such as military dolls, and dolls which exhibit specific bodily functions, such as crying dolls. It has also become common to provide with dolls ancillary equipment, such as clothing and miniature replicas of articles for use in play with the doll.

SUMMARY OF THE INVENTION

This invention is based upon an appreciation that although young children frequently play "nurses" or "doctors", the "patients" are generally other young children and the maladies or injuries are totally imaginary and the treatment merely simulated. Sometimes a doll is used as the "patient" but again the play requires imagined maladies or injuries and imaginary or at best only roughly simulated treatment.

The primary object of the invention is to introduce a greater level of realism into the play, and the invention thus provides a doll which can be made "sick", in the sense that a simulated symptom or symptoms can be made observable, and which can be "treated" by a realistic simulation of actual treatment, with the simulated symptom or symptoms then diminishing or disappearing in automatic response to the simulated treatment. The various symptoms provided are those objective symptoms of illnesses commonly treated by administering internal medication or by surgery. According to one particularly advantageous embodiment of the invention, the doll has a mouth orifice and means for raising the temperature of a part of the doll to simulate a fever, and the mouth orifice is adapted for insertion of a temperature measuring instrument, typically a simulated thermometer. Alternatively, the doll is provided with a rectal orifice, into which the temperature measuring instrument is inserted, or the doll is so constructed and arranged that one of the arms can be manipulated to retain the temperature measuring instrument in the armpit region, with the necessary clamping relationship between the arm and body being achieved by providing a high frictional resistance to movement of the arm at the joint, by providing a manually releasable ratchet for operating the joint in an appropriate sense, or by using a manually expandible ball-and-socket connection as the joint for the arm.

The simulated symptom can be fever; skin appearance, as in measles; swelling, as in mumps, heart beat rate, or any other simulated symptom which can be detected by the senses of a child playing with the doll. When the symptom is fever, a part of the doll, such as the forehead, can be warmed by a resistor in a circuit powered by a battery housed with the doll or by any other suitable source, a switch being provided in the circuit to respond to a treatment act, such as insertion of medicine in the mouth orifice, to switch off the current supply to the resistor, a delay in disappearance of the symptoms being provided inherently by the normal cooling time or by including a time delay device in the circuit. A change in skin color, simulating a symptom, can be accomplished by making the skin of the doll transparent or translucent or foraminous, providing a color filter beneath the skin, and providing an electric lamp within the doll to direct light through the filter and skin when an electric circuit is completed. Swelling of, e.g., the cheecks to simulate mumps, can be achieved by making the cheeks of elastic material and providing a source of compressed air, such as a simple pump device, to inflate the cheeks, a valve being provided to deflate the cheeks in response to the treatment act.

It is particularly advantageous to employ insertion of a spoon into the mouth orifice as the treatment-simulating act, with insertion of the spoon operating a switch or a valve to terminate a simulated symptom. In such case, the switch or valve can be operated manually to close, and a simulated thermometer can be employed which, when inserted in the mouth orifice, will indicate a fever when the switch or valve is closed and indicate a normal temperature when the switch or valve has been opened by insertion of the spoon. Multiple symptoms can be simulated for a single illness. Thus, the doll can be provided with closable eyes and the eyes actuated to close when the fever simulation or the condition of mumps (swollen neck or cheeks) is present. Similarly, for simulation of measles, both the fever and skin spots can be simulated concurrently.

BRIEF DESCRIPTION OF THE DRAWINGS

In order that the manner in which the foregoing and other objects are achieved according to the invention can be understood in detail, particularly advantageous embodiments thereof will be described with reference to the accompanying drawings, wherein.

DESCRIPTION OF THE PREFERRED EMBODIMENTS

Figure 1:
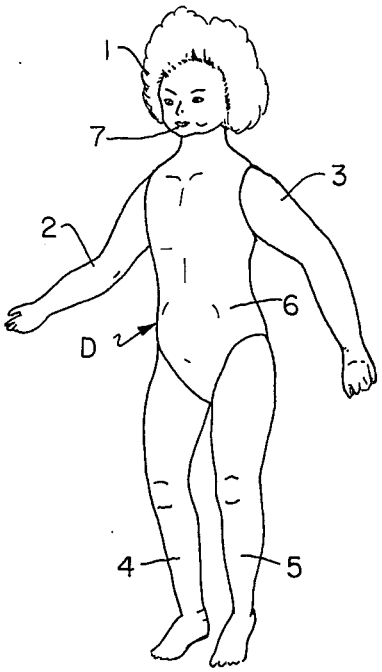
FIG. 1 is a perspective view of a typical doll to which the invention can be applied.
Figure 2:
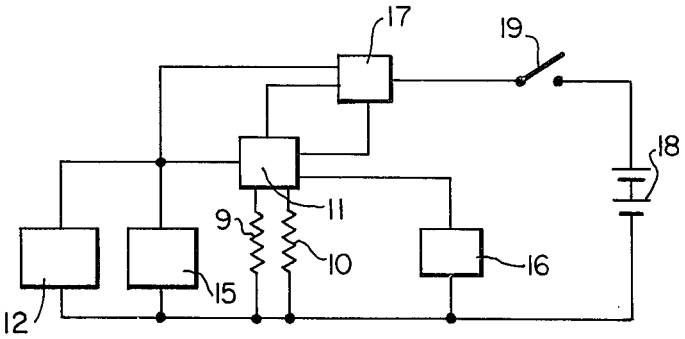
FIG. 2 is a schematic diagram of a typical circuit forming part of the invention.

Referring first to FIGS. 1 and 2, the doll D is externally of conventional form and comprises the usual head 1, arms 2 and 3, legs 4 and 5 are trunk 6. The mouth portion 7 defines an aperture capable of receiving a simulated thermometer and an actuator, such as a toy spoon or a medicament pill simulating member, both later described and each advantageously of a suitable polymeric material. The doll is provided with an electrical resistance heater, in the mouth area if the simulated thermometer is heat-responsive, in another area, such as the forehead area if the simulated thermometer is not heat-responsive. The doll can be provided with a second electrical resistance heater, e.g., in the rectal area if the simulated thermometer is heat-responsive, or the small of the back of the doll if the simulated thermometer is not heat-responsive. When in the mouth area, the resistance heater can be annular to accommodate insertion of the thermometer or other actuating member.

Considering FIG. 2, the doll of FIG. 1 can comprise an electrical circuit comprising a first heating resistor 9, for the mouth region or forehead, and a second heating resistor 10, for the rectal region or the small of the back, a switching device 11 constructed and arranged to be operated by the toy spoon, pill-simulating member or other actuator, switching device 11 being operable from the exterior of the doll body, as by insertion of the toy spoon through the mouth aperture.

An electrically operated actuator 12, such as an electromagnetic actuator to close the eyes 13 of the doll, FIG. 1, or for establishing a simulated symptom other than fever, is connected in parallel with resistance heaters 9 and 10 when switching device 11 is actuated to its closed condition. A conventional disc or talking strip device is also provided, connected in parallel with the heaters and eye-actuator when device 11 is closed. Device 15 can be operated to play a recording saying, e.g., "I feel sick," whenever device 11 is closed to energize the heaters. A second conventional disc or talking strip device 16 can be provided, connected to operate in response to opening of switching device 11 to turn off heaters 9 and 10. Device 16 can be operated by a recording saying, e.g., "I feel good." The circuit is powered by batteries 18 and can include a manual ON-OFF switch 19. If desired, a conventional time delay device 17 can be employed, connected to delay the effect of switching device 11 when device 11 is opened.

FIGS. 3–7 illustrate in greater detail one advantageous embodiment wherein the doll D is of conventional form, produced, for example, by slush casting from a plasticized polyvinyl chloride. Head 1, FIG. 3, includes, as is conventional, a lower portion 1*a* which includes mouth orifice 7 and forehead 20 and is joined at 21 to torso 6. Head 1 is completed by a removable skull closure, indicated in phantom at 22. A support member 23 fits snugly within lower head portion 1*a* and supports switching device 11 in alignment with mouth aperture 7. Support member 23 also supports resistance heater 9 in such fashion as to urge the heater against the inner surface of forehead portion 20.

Figure 4:
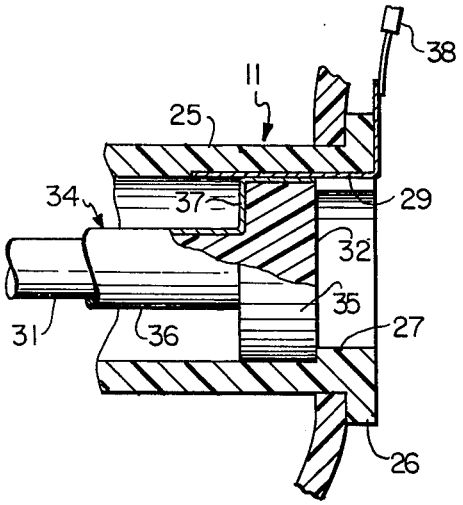
FIG. 4 is an enlarged fragmentary view showing a portion of the doll of FIG. 3 in detail.

In this embodiment, switching device 11 is constructed and arranged to be actuated manually to its closed position and to be opened by insertion of a toy spoon through mouth aperture 7 in simulation of administration of a liquid oral medication, as later described. Device 11 comprises a tubular body 25 provided at one end with an outwardly projecting transverse annular shoulder 26 and an inwardly projecting transverse annular shoulder 27, FIG. 4, and at the other end with an inwardly projecting stop member 28. Fixed contact 29 is in the form of a thin metal strip extending first inwardly across the end face of body 25, thence through a notch in shoulder 27 and for a short distance along the inner surface of body 25. Device 11 includes a movable member indicated generally at 30 and comprising an elongated actuating rod 31, of rigid polymeric maerial having good electrical insulating properties, an enlarged head 32 at one of the rod, and an operating knob 33 at the other. The movable contact 34, best seen in FIG. 4, is a tubular stamping of thin sheet metal and comprises a right cylindrical larger portion 35, which tightly embraces head 32, and a smaller diameter portion 36, which embraces rod 31, as seen in FIG. 4, portions 35 and 36 being joined by a transverse annular portion 37. The outwardly projecting end portion of fixed contact 29 is connected to one lead 38 for resistance heater 9. Portion 36 of movable contact 34 is connected to conductor 39 which in turn is connected to one of two retaining contacts 40 of the two-battery holder 41 which holds two dry cells 18. The other retaining contact 40 is connected to the remaining lead 42 for resistance heater 9, and the remaining terminals of the two batteries 18 are interconnected at 43.

Figure 3:
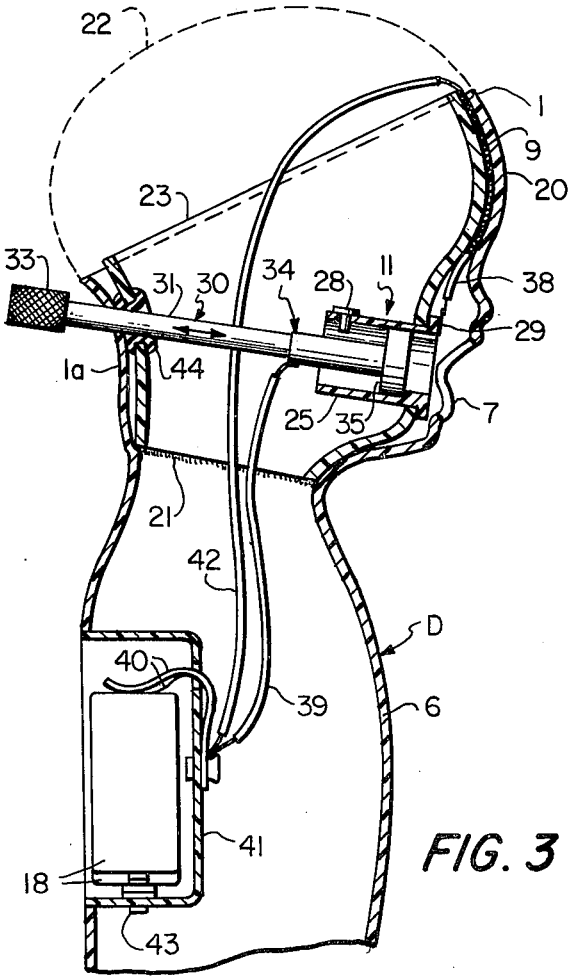
FIG. 3 is a view, partly in longitudinal cross-section and partly in side elevation, of a doll according to one particularly advantageous embodiment of the invention.

Rod 31 extends through matching apertures in the walls of head portion 1*a* and support member 23, in locations opposite mouth aperture 7, a grommet 44, FIG. 3, being carried by member 23 and slidably engaging rod 31. The switching device 11 can thus be closed by grasping knob 33 and pushing rod 31 toward mouth aperture 7 until head 32 engages shoulder 27 of body 25, movable contact portion 35 then being in good electrical contact with fixed contact 29. The switch can be opened by moving rod 31 in the opposite direction until contact portion 37 engages stop member 28, movable contact portion 35 then being out of contact with fixed contact 29.

Figure 5:
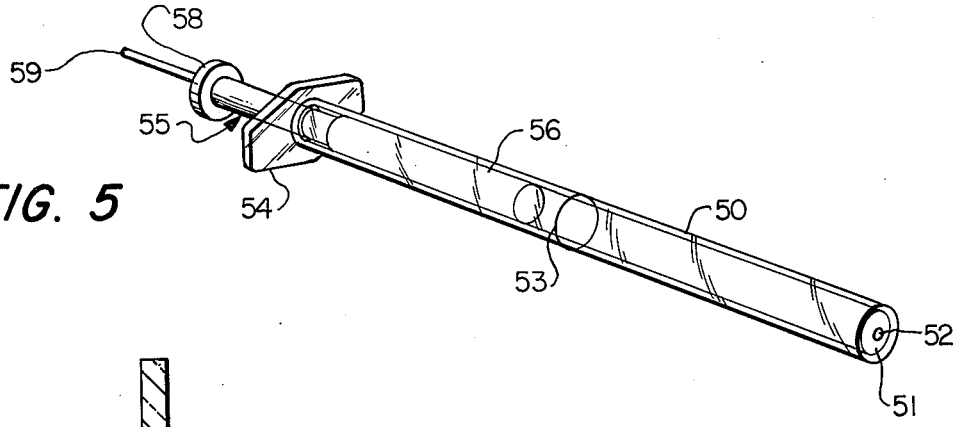
FIG. 5 is a perspective view of a simulated fever thermometer for use with the doll of FIG. 3.

A simulated fever thermometer for use with the apparatus of FIGS. 1–4 is shown in FIG. 5 to include a right cylindrical tubular hollow body 50 of transparent polymeric material. An end wall 51 closes one end of body 50 except for a small vent hole 52 therein which prevents air pressure buildup within the body. A "fever line" 53 is scribed or marked with color on body 50 to simulate, in simplified fashion recognizable by a child, normal body temperature of 98.6° F. (37° C.). A flange 54 of a generally rectangular, polygonal shape is fixedly attached to the open end of body 50, the flange having a central opening therethrough into body 50 of smaller diameter than the inner diameter of body 50. Flange 54 is dimensioned so that it has at least one transverse diametrical dimension greater than the largest transverse or diametrical dimension of the mouth opening defined by mouth portion 7 of the doll to prevent insertion of that end of body 50 therethrough.

An indicator rod indicated generally at 55 extends through the opening in flange 54 and into body 50, rod 55 having a colored outer surface and being substantially opaque to simulate the mercury or other temperature indicating liquid normally found in a real thermometer. Rod 55 would therefore preferably be colored red or silver and can be made of a suitable relatively hard polymeric material. The inner end 56 of rod 55 is enlarged to exceed the inner diameter of the opening through flange 54, thereby defining a shoulder 57 which abuts the inner surface of flange 54 and prevents removal of rod 55 from body 50. As will be seen in FIG. 6, the central opening of flange 54 is smaller than the inner diameter of body 50 and smaller than enlarged end 56 of rod 55 with the flange being welded or adhered to the open end of body 50 when rod 55 is inserted into the body during assembly. The opening through flange 54 can also be carefully dimensioned so that it lightly frictionally engages the outer surface of the smaller portion of rod 55 so that, when the rod is moved to a specific position, it remains in that position until intentionally displaced.

At the other, outer end of rod 55 is a circular flange 58 which is fixedly attached to and extends radially outwardly from rod 55, the outer diameter of flange 58 being selected to be slightly smaller than the circular opening defined by shoulder 27 within the mouth of the doll. A pin 59 extends coaxially from rod 55 beyond flange 58, the pin being fixedly attached to, or forming a part of, rod 55.

The length of rod 55 between flange 58 and the other end of enlarged portion 56 is chosen to be shorter than the interior length of body 50 so that when rod 55 is fully inserted into body 50 to the point at which flange 58 abuts flange 54, end portion 56 of the rod extends beyond fever line 53, simulating the appearance of a fever condition. Before use, the thermometer can be "shaken down" by grasping the end of body 50 adjacent end wall 51 and whipping the thermometer with a twisting motion of the wrist as is commonly done with a conventional "real" fever thermometer causing rod 55 to emerge from body 50 by centrifugal force until shoulder 57 of the enlarged portion 56 contacts the inner surface of flange 54. The inner end of rod 55 is then located to the left of fever line 53, as seen in FIG. 5, and the thermometer is ready for use with the doll to make a simulated temperature measurement.

Figure 6:
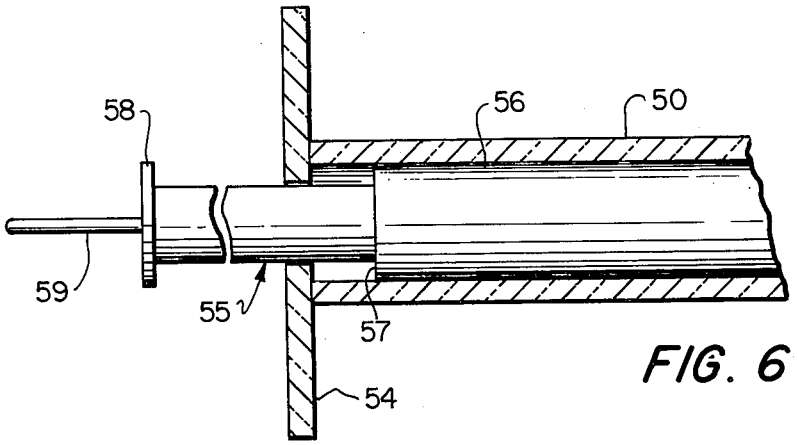
FIG. 6 is a partial foreshortened side elevation, in partial section, of the thermometer of FIG. 5.
Figure 7:
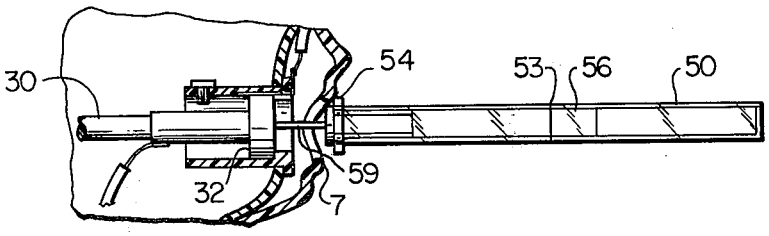
FIGS. 7 and 9 are partial side elevations of the mouth portion of the doll of FIG. 3 showing simulated temperature measurements under "sick" and "well" conditions, respectively.
Figure 8:
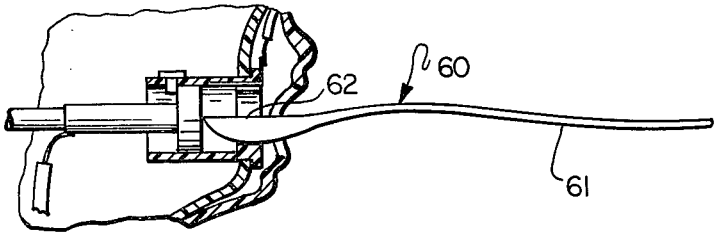
FIG. 8 is a partial side elevation of the mouth portion of the doll of FIG. 3 showing one form of simulated treatment.
Figure 9:
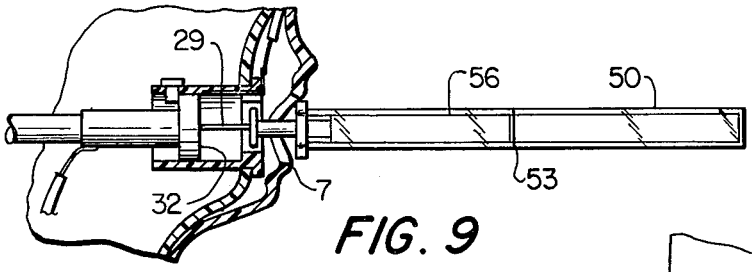

The use of the thermometer shown in FIGS. 5 and 6 in conjunction with the doll of FIG. 1–4 is illustrated in FIGS. 7–9. As shown in FIG. 7, shaft 30 has been actuated to complete a circuit for the fever-producing heating element, as previously described, with enlarged end portion 32 of the switch mechanism being pushed to its position closest to the opening defined by mouth 7 of the doll. Upon detection of the simulated fever condition, a diagnosis is made by placing the thermometer into position in the mouth opening so that flange 54 contacts the opening defined by the lips and pin 59 extends through the mouth opening and into the opening defined by shoulders 27 so that pin 59 comes in contact with the exposed end surface of portion 32. If the thermometer has been properly shaken down, pin 59 contacts the surface of member 32 before the flange comes in contact with the lips, causing rod 55 to be pushed into body 50. The length of pin 59 is sufficient to cause the enlarged end portion 56 of rod 55 to be moved past fever line 53, confirming by "temperature measurement" the existence of the fever.

Simulated treatment of the condition is effected as shown in FIG. 8 by inserting through the mouth opening a spoon indicated generally at 60, the spoon being conventional in nature in the sense that it has a handle portion 61 and a bowl portion 62, the only special characteristics of the spoon being that it is relatively still and that the dimensions of the bowl portion 62 are such that it can be inserted through the mouth opening and completely through the opening defined by shoulder portions 27. In simulated treatment, the spoon is inserted into the mouth and pressed against end portion 32 of the switch mechanism, causing the switch mechanism and its associated rod 30 to move axially until enlarged end portion 32 comes in contact with stop member 38. This breaks the electrical contact between contact portions 29 and 37, removing electrical energy from heater 9 in the forehead of the doll, permitting that heater to cool. Thereafter, a further simulated temperature measurement of the doll can be made by again "shaking down" the thermometer as previously described. The thermometer is then inserted through the mouth opening in the manner shown in FIG. 9 so that flange 54 again comes in contact with mouth defining lip portions 7 and pin 59 comes in contact with enlarged portion 32 of the switch mechanism. The lengths of pin 59 and rod 55 are selected so that rod 59 is moved axially into body 50, but only to the position at which the distal end of enlarged portion 56 comes into approximate alignment with fever line 53, thereby indicating the existence of a "normal" temperature condition in the doll. Thus, the thermometer again indicates that the treatment has been effective and that the ailment has been cured.

Figure 10:
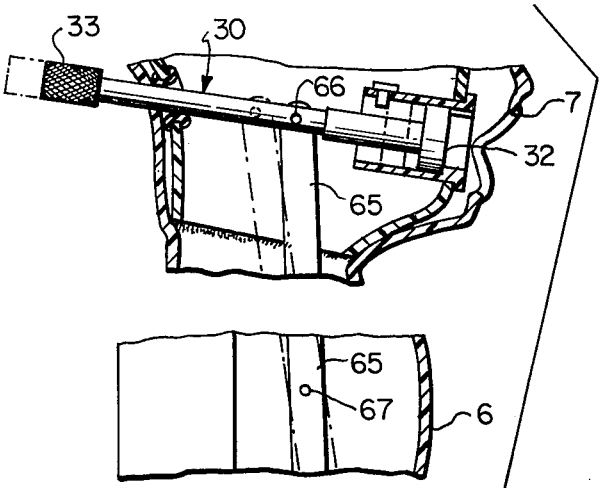
FIG. 10 is a partial side elevation in partial section of a further embodiment of a doll accoding to the invention showing anal temperature measurement.
Figure 10:
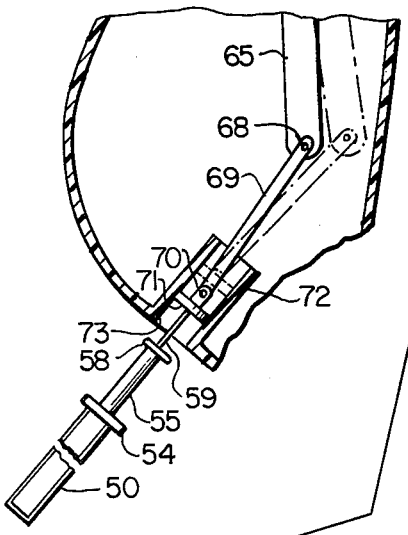

An embodiment of the invention which permits anal temperature measurement is shown in FIG. 10, the apparatus of FIG. 10 being similar in nature, in the head portion of the doll to that discussed with reference to FIG. 3. In addition to that apparatus, there is provided an elongated link member 65 which is pivotally connected to rod 30 by a pin 66, link 65 being pivotable about a fixed axle 67 which is mounted on the body of the doll and which is located near the midpoint of link 65. At the lower end of link 65 is a pivot pin 68 which is pivotally connected to a link 69, the other end of link 69 being pivotally connected by a pin 70 to a plunger 71. Plunger 71 is axially movable within a right circular cylindrical sleeve 72 integrally formed with the body of the doll and extending perpendicularly inwardly from the buttocks portion of the doll in approximately the region of the anus. The body of the doll is provided with an opening 73 at the outer end of the sleeve to permit insertion of the simulated thermometer described with reference to FIGS. 5 and 6.

Plunger member 71 is capable of assuming two positions of interest, one position being shown in solid lines in FIG. 10, that position being the one in which enlarged portion 32 of the switch mechanism behind the mouth of the doll is in the circuit-closing position to cause symptoms of an illness. The other position, shown in dotted lines, is that in which a "normal" condition of health of the doll is being simulated wherein the plunger is withdrawn toward the interior of the doll within sleeve 72. As will be seen in the figure, when the plunger is in the "illness" position as shown in solid lines, insertion of the thermometer causes pin 59 to contact the plunger and push rod 55 into body 50 to the point at which the enlarged end of the rod extends beyond the fever line of the thermometer, indicating an elevated temperature condition. However, when enlarged portion 32 and shaft 30 are in their withdrawn positions, as moved by a treatment device such as the spoon illustrated in FIG. 8, pivot pin 66 moves the upper end of link 65 away from the mouth region and simultaneously moves the lower end of link 65, along with pin 68 and link 69 toward the abdomen of the doll and away from the simulated anal opening. Thus, when the thermometer is properly shaken down and inserted into the anal opening, pin 59 is caused to move rod 55 only to the point at which the enlarged end of the rod is approximately in the vicinity of the fever line, indicating a normal temperature condition.

Figure 11:
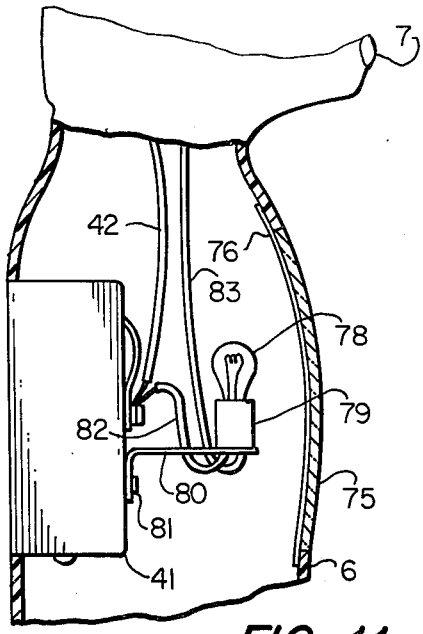
FIG. 11 is a partial side elevation partially in section of a further embodiment of a doll according to the invention showing simulation of measles.
Figure 12:
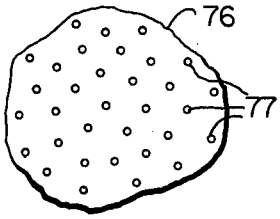
FIGS. 12 and 13 are partial front elevations of a doll according to FIG. 11.

A further embodiment of the invention is shown in FIGS. 11 and 12, FIG. 11 showing a portion of the body of the doll discussed with reference to FIG. 3, but with certain modifications. As shown in FIG. 11, the chest portion of the doll includes a transparent panel 75 which is inset into the body of the doll and replaces a portion thereof. Panel 75 is generally rectangular in shape and extends from just below the neck portion to a suitable location in the abdomen and, transversely, from a position close to one arm opening to the opposite arm opening. A layer of color filter material 76 is adhered to the inner surface of the doll body and extends beyond the lateral margins of panel 75. Filter material 76, a portion of which is shown in FIG. 12, is designed to be opaque over most of its extent, but includes a plurality of substantially randomly dispersed translucent portions 77 giving a spotty appearance. Portions 77 are capable of transmitting light in the red region of the visible spectrum so that, when the combination of material 76 and panel 75 is illuminated from within the body, a plurality of red spots appear to exist in the chest and abdomen region, simulating the existence of a malady such as measles. Material 76 can be produced by providing a film of conventional red light filtering material, such as red colored cellophane or the like, and coating the surface thereof, except for regions 77, with an opaque paint or other coating.

To provide the illumination, a lamp 78 is mounted in a conventional socket 79 within the body of the doll and behind the transparent panel 75, the lamp being spaced from the interior surface of material 76 at a sufficient distance to prevent heat damage from the lamp to the material and to disperse the light from lamp 78 generally over the entire interior portion of material 76. Socket 79 is supported on an L-shaped bracket 80 which can be mounted, as by a rivet 81, to battery container 41.

The electrical connections for the lamp and socket can be made to the battery in either series or parallel electrical connections to the battery and through the switch assembly discussed with reference to FIGS. 3 and 4. As shown in FIG. 11, the connection is a series circuit relationship wherein a conductor 82 is connected to one end terminal of the batteries to one terminal of socket 79, the other terminal of the socket being connected through a conductor 83 to the switch assembly. The heater element which can also be used in conjunction with the measles simulation shown in FIG. 11 in view of the fact that measles is generally accompanied by a fever, can be connected in series with the switch, the return conductor 42 from the heater element being connected from the other terminal of the battery assembly.

Figure 13:
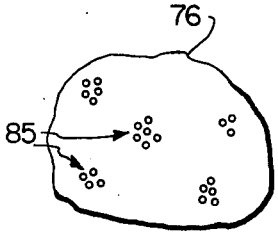

The pattern of spots to be provided on materials 76 can, of course, be varied to more closely simulate the groups of eruptions which are sometimes characteristics of certain varieties of the disease known commonly as measles as shown by the groups of spots in FIG. 13. It will also be recognized that similar regions in the head portion of the doll can be provided with a separate illuminating lamp or lamps, depending upon the size of the doll and the desired degree of complexity and realism to be simulated. An alternative arrangement for obtaining the measles symptom can be obtained by providing a panel 87 which is inset into the front portion of the body 6 of the doll in a manner similar to panel 75 except that panel 87 is opaque and of the same opaque material as the remainder of the doll and is provided with a plurality of perforations 88 arranged in accordance with one of the desired patterns such as shown in FIGS. 12 and 13. A layer of red filter material 89 is then provided on the back of the chest portion and is again illuminated as by a lamp 78. In this case, the filter material can simply be a red cellophane or gelatin filter and need not be coated with the opaque material previously described.

Figure 14:
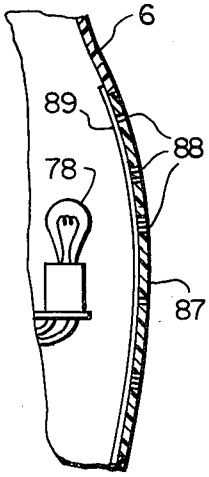
FIG. 14 is a partial side elevation partially in section of an alternate embodiment of FIG. 11.

Again, while the technique is not specifically illustrated, the perforated panel technique disclosed in FIG. 14 can be equally well applied to the cheek or forehead portions of the doll to simulate the "rash" symptons typical of certian illnesses.

Figure 15:
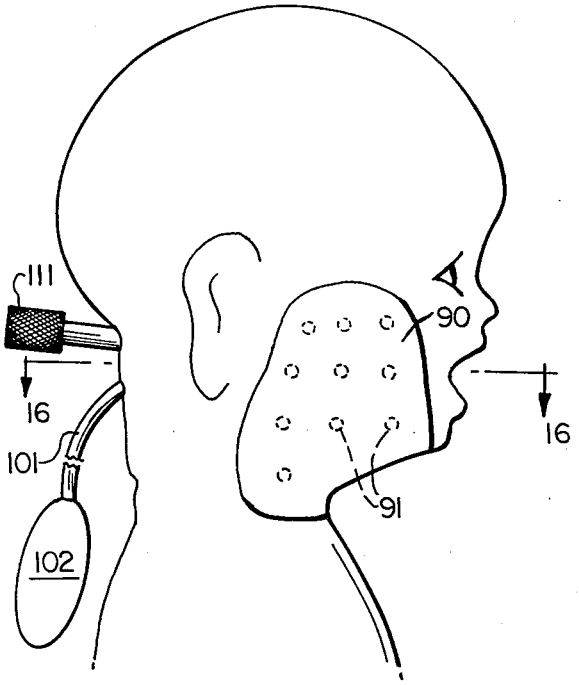
FIG. 15 is a partial side elevation of the head portion of a doll according to the invention.
Figure 16:
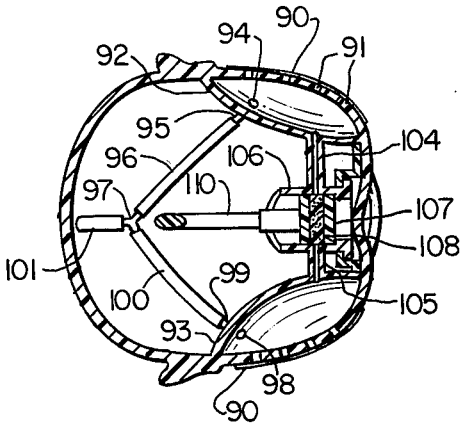
FIG. 16 is a transverse section along lines 16—16 of FIG. 15.
Figure 17:
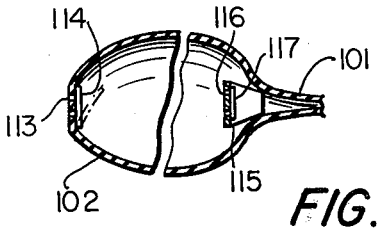
FIG. 17 is a side elevation in section of a pump bulb usable in the embodiment of FIGS. 15 and 16.

A further embodiment of the invention for the purpose of simulating the symptoms of mumps is shown in FIGS. 15–17. As shown therein, the cheek and anterior neck portions of the doll are provided with a flexible, elastic covering 90 which can comprise a relatively thin sheet of rubber or rubber-like material adhered at the edges only to the relatively rigid shell material forming the face and neck portions of the doll. The shell portions of the doll head underneath that region of the face covered by sheet 90 is provided with a plurality of openings 91 through which air can pass to act against the inner surface of sheet 90. As seen in FIG. 16, the interior of the doll can be provided with walls 92 and 93 which extend from the region of the ears to the regions adjacent the nose on the interior of the doll head, walls 92 and 93 being curved in the vertical direction to form pockets which extend from a level just below the eyes of the doll to a convenient location in the neck. The pockets defined by walls 92 and 93 and the cheek portions of the doll head are airtight except for openings 91 and inlet and outlet openings for the air, to be discussed. Wall 92 is provided with an opening 94 therethrough, the outer end at that opening having a small cylindrical plastic nipple 95 adhered thereto. A hose 96 surrounds and is adhered to the nipple in airtight fashion, the other end of the hose being connected to a Y junction 97 of a tubular material similar to nipple 95. A similar opening 98 and nipple 99 are provided in wall 93 and a hose 100 is connected between nipple 99 and another point on Y junction 97. A hose 101 extends from the third tubular portion of Y junction 97 and through an opening in the rear neck or head portion of the doll and is connected to a conventional squeeze-bulb pump 102.

Vent openings for the pockets are provided, these constituting conduits 104 and 105 which extend between walls 92 and 93, respectively, and a cylindrical portion 106 which is fixedly attached to the shell portion of the doll in a manner substantially identical to sleeve body 25, described with reference to FIG. 3. However, in the embodiment shown in FIG. 16, switch details have been omitted. Within sleeve 106 there is provided a plunger or piston assembly 107 having a central sealing ring 108. Piston 107 can move between a forward position, closest to the mouth opening of the doll as shown in FIG. 16, or a rear position in which the piston is adjacent the open end of sleeve 106, this motion being accompanied by motion of a shaft 110 which extends outwardly through the rear portion of the doll head and terminating in a knob 111. This shaft and knob arrangement are also substantially identical to shaft 31 and knob 33 of the embodiment of FIG. 3. As will be seen, conduits 104 and 105 have very small interior passages which interconnect the pockets defined by walls 92 and 93 and the interior of sleeve 106. When the piston 107 is in its most forward position, ceiling ring 108 closes the ends of conduits 104 and 105, preventing escape of air from the cheek pockets. Pump 102 can then be repetitively operated to increase the air pressure within the pocket, causing sheets 90 to inflate, simulating the condition of enlarged glands which is a well-recognized sympton of mumps.

The condition can be further diagnosed by inserting the thermometer of FIGS. 5 and 6 as shown in FIG. 7 to indicate the presence of a moderate fever which commonly accompanies mumps. The condition can be "cured" by inserting a spoon, as shown in FIG. 8, the spoon being used to move piston 107 rearwardly, opening the ends of conduits 104 and 105 to permit the gradual release of air from the pocket, resulting in deflation of elastic sheets 90. As will be recognized, this embodiment can also be used in conjunction with the heating element and switch arrangement of FIG. 3 to additionally simulate the condition of a fever by elevating the temperature of the forehead.

A pump 102 of a type usable in connection with the device of FIGS. 15 and 16 is shown in FIG. 17, the pump including a rubber ball or the like having air intake openings 113 covered by a flap valve 114 of a resilient material arranged so that the valve can flex away from opening 113 to admit air. A plug 115 is provided at the other end of the ball at the connection thereof to hose 101, plug 115 having openings 116 and a flap valve 117 to permit egress of air from ball 102 into conduit 101. As will be seen, squeezing the bulb 102 permits air to enter the conduit and release of the bulb closes flap valve 117 and opens valve 114 to admit air to the bulb as it resumes its normal shape.

If desired, a pump similar to that shown in FIG. 17 can be incorporated in a limb of the doll or the body thereof with hose 101 running through the body up to the hose connection in the doll head. Thus, repeated squeezing of the limb or body portion where the pump is located inflates sheets 90 to produce the symptoms of the illness.

As an alternative embodiment, a mechanical linkage operated by shaft 110 can be provided to move against flexible portions in the position of sheets 90 so that movement of knob 111 and the shaft produces the symptoms and reverse movement of the shaft and piston restores the cheeks to their normal shape.

Figure 18:
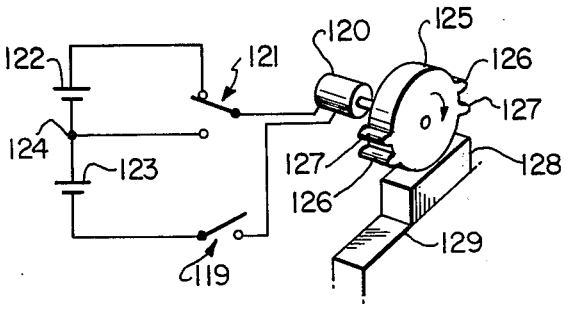
FIG. 18 is a schematic representation of an apparatus for simulating tachycardia usable in the apparatus of FIGS. 3 or 10.

Another illness which can be simulated by operation of the same switch mechanism as that shown in FIG. 3 is shown in FIG. 18, this being the condition of an elevated heart beat rate (tachycardia). In this system, a small d.c. motor 120 is provided within the doll and is electrically connected to the battery circuit. One terminal of the motor is connected to a single-pole, double-throw switch indicated generally at 121, one fixed contact of the switch being connected to one terminal of a battery 122 which is mounted in the doll in series connection with a battery 123. The junction 124 between the batteries is connected to the other fixed contact of switch 121. The other end of the series battery connection is connected through switch 11, adjacent the mouth of the doll, to the other motor terminal.

A drum 125 is driven by motor 120 and is provided with one or more sets of projections, each set including a relatively large projection 126 and a relatively small projection 127. Adjacent the drum is provided a hollow box 128 or similar resonant sound-producing device which is supported on a resilient spring member 129 which is, in turn, mounted at some convenient fixed location within the doll body such as, for example, housing 41 for the batteries. Regardless of the position of switch 121, when switch 11 is closed, the motor rotates and drives the drum, causing the projection to strike the resonant box 128, producing a "thump" sound resembling a heartbeat. The sequence of the box being struck by the smaller and then the larger of the projections produces the sound typical of the pulsations produced by sequential contraction of the two major chambers of the heart. The number of sets of projections depends upon the diameter of the drum and the rotational speed of motor 120. The sound produced by this apparatus can be detected by using a conventional stethoscope, not illustrated.

Switch 121, which can be operated by shaft 31, can be moved to the position shown in FIG. 18 when enlarged portion 32 is moved toward the mouth of the doll. In this position, the voltage of both batteries is applied to motor 120, causing the motor to run at an elevated speed and thereby causing the heartbeat to be elevated, simulating tachycardia. Application of medication as by the spoon previously described, can be used to return the switch to its opposite position in which arrangement the voltage of only battery 123 is applied to the motor, causing the motor to run at a lower speed and producing a sequence of "heartbeats" at a lower rate, simulating a normal cardiac cycle.

A similar circuit arrangement can be employed to operate a recording device within the doll to cause the doll to cough. Devices such as those shown in U.S. Pat. Nos. 3,222,073 or 3,319,965 can be incorporated in the body of the doll, these devices being provided with recordings of a cough-like sound so that when the shaft and plunger such as that shown in FIG. 3 are moved to the position adjacent the mouth, the recorder is energized, causing the cough. Application of "medication" with the spoon returns the shaft and terminates the coughing sound. A second recording device could also be connected in the apparatus to cause the doll to say, for example, "I feel better now".

Figure 19:
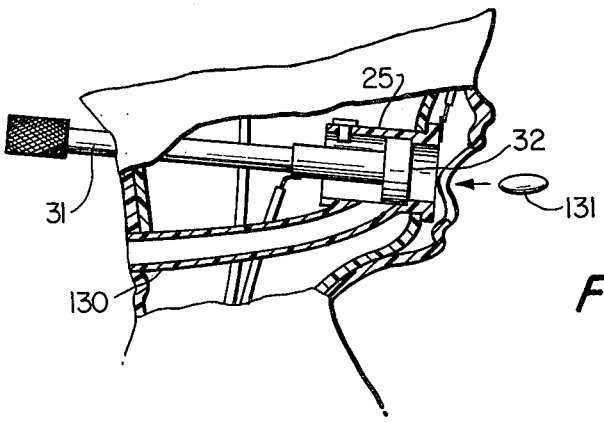
FIG. 19 is a partial side elevation in partial section showing an alternate form of administering simulated treatment.

In place of the spoon, a pill can be employed to produce the simulated curative effect, an apparatus suitable for this purpose being illustrated in FIG. 19. This apparatus is substantially identical to that shown in FIG. 3, except that a passage is created between the mouth portion of the doll and the back of the doll's head or neck, this passage being defined by a molded plastic conduit 130 extending between body 25 and the back of the neck. A pill 131 of relatively hard plastic material can be inserted in the mouth pushing member 32 and shaft 31 toward the back of the doll's head, whereupon the pill enters and passes through the doll's head in conduit 130, being recovered at the back of the head. This pill can be applied to cure any of the illnesses simulated by devices described herein.

In addition to the above, it will be clear that other specific illnesses can be simulated and cured using the mechanisms of the present invention.

Surgical incisions may be provided at known operable portions of the body with simulated stitching on either side. The incisions may be closed with hook and eye inter-engaging strips such as those sold under the trademark "VELCRO".

The doll may be made of resilient material and inflatable bag means can be disposed in areas where swellings may be expected. Furthermore, one or more limbs may be articulated or of multipart construction to simulate a break, setting of the break being effected by inflation of a ballon disposed within the limbs and a "cast" being applied to support the limb.

A variety of other conditions can be simulated and made evident according to the sophistication of the doll. Thus, for example, indicator fluids may be provided for transferring to relevant parts of the doll upon the applications of pressures to appropriate parts thereof, such fluids being visible at such relevant parts through orifices provided in the doll, suitable illumination being provided if necessary.

As will be appreciated, according to the degree of realism introduced it will be possible to simulate, in a very general manner, various pediatric conditions and thus the doll can conveniently be used in seeking to allay the fears of a child about to undergo minor surgery. Thus, the administering of an anaesthetic and the effect on the "patient" can be shown to the child by reference to a "sick" doll having an aperture in say, the upper part of an arm to receive the needle of a toy syringe, the doll's eyes being arranged to close in timed relationship to the administering of an anaesthetic and, more importantly, to reopen after a predetermined period of time consistent with the time taken to effect the surgery. As an alternative to simulating the adminsitration of an anaesthetic by means of a syringe, it may be preferred to use a pediatric anaesthetic mask, the mask being positioned over the doll's face. Conveniently, by moving the mask towards and into contact with the doll's face suitably positioned magnets will be activated to operate the mechanism for closing the doll's eyes and to operate a sound strip to cause the doll to make a noise approximating to such as "I feel sleepy".

In a still further arrangement, one or both eyeballs of the doll will be pivotable and cooperable magnetic or other means will be provided to align a misaligned eyeball on the application of spectacles to the doll, such a doll being of advantageous use in conditioning a child to the need to wear glasses for treating such a condition.

Minor surgery can be simulated in a like manner, and thus the child can be shown that the malady or injury can be cured or treated.

While certain advantageous embodiments have been chosen to illustrate the invention, it will be understood by those skilled in the art that various changes and modifications can be made therein without departing from the scope of the invention as defined in the appended claims.

What is claimed is:

1. A doll and, in combination therewith, first means mounted in said doll for exhibiting simulation of an objective symptom of illness in a fashion detectable by the senses of a child, the doll being constructed and arranged to accommmodate a simulated treatment for the illness characterized by the simulated symptom; and second means mounted in said doll operatively connected to said first means, and responsive to occurrence of said simulated treatment, for deactivating said first means and thereby causing the exhibition of the simulated symptom to at least diminish;

wherein said first means includes electrical resistance heater means for generating heat observable as a simulation of fever; and said second means comprises switch means connected to said resistance heater means to deactivate the same when said switch means is actuated as a result of occurrences of said simulated treatment and includes a member movable between a first position adjacent an orifice in the doll wherein said first means is activated and a second position away from said orifice wherein said first means is deactivated;

and wherein said combination further comprises a simulated thermometer having relatively movable means therein insertable into said orifice and responsive to the presence of said member in said first position to indicate a simulated fever condition.

2. The combination defined in claim 1 and further including a body insertable into said orifice, and wherein said simulated treatment comprises insertion of said body into said orifice to restore said member to said second position.

3. The combination defined in claim 1 wherein said orifice is the mouth of the doll.

4. The combination according to claim 1 wherein said simulated thermometer includes an elongated tubular body at least a portion of which is transparent, said body having a reference mark thereon; and a transverse flange at one end of said body, said flange being dimensioned to contact the portion of said doll around said orifice and to prevent passage thereof through said orifice;

an axial extension connection to said indicator portion and protruding out of said one end of said body, said extension being dimensioned to pass through said orifice and contact said movable member to position said indicator portion in said body relative to said reference mark and to thereby indicate the position of said movable member as an indiction of simulated fever.

5. A doll and, in combination therewith, first means mounted in said doll for exhibiting simulation of an objective symptom of illness in a fashion detectable by the senses of a child, the doll being constructed and arranged to accommodate a simulated treatment for the illness characterized by the simulated symptom; and second means mounted in said doll operatively connected to said first means, and responsive to occurrence of said simulated treatment, for deactivating said first means and thereby causing the exhibition of the simulated symptom to at least diminish;

wherein said first means includes electrical circuit means for causing a change in the physical condition of said doll observable as a simulation of said symptom, and said second means comprises switch means connected to said electrical circuit means to deactivate said circuit means when said switch means is actuated as a result of an occurrence of said simulated treatment, said switch means including a member movable between a first position adjacent an orifice in the doll wherein said electrical circuit means is activated, and a second position away from said orifice wherein said electrical circuit means is deactivated;

the combination further comprising a simulated thermomenter including an elongated tubular body at least a portion of which is transparent, said body having a reference mark thereon; and a transverse flange at one end of said body, said flange being dimensioned to contact the portion of said doll around said orifice and to prevent passage thereof through said orifice;

said relatively movable means including an indicator portion axially slidable within said body, and an axial extension connected to said indicator portion and protruding out of said one end of said body, said extension being dimensioned to pass through said orifice and contact said movable member to position said indicator portion in said body relative to said reference mark and to thereby indicate the position of said movable member as an indication of simulated fever.

6. The combination defined in claim 1 wherein said orifice is the anus of the doll.

7. The combination according to claim 5 and further including a rigid body insertable into an orifice of said doll, and wherein said simulated treatment comprises insertion of said rigid body into said orifice of said doll.

8. The combination according to claim 7 wherein said rigid body is a spoon.

* * * * *